US007922520B2

(12) United States Patent
Mizukami

(10) Patent No.: US 7,922,520 B2
(45) Date of Patent: Apr. 12, 2011

(54) CABLE CONNECTOR INCLUDING INTERMEDIARY INTERCONNECTION BOARD

(75) Inventor: Kazuhiro Mizukami, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 128 days.

(21) Appl. No.: 12/481,734

(22) Filed: Jun. 10, 2009

(65) Prior Publication Data

US 2009/0325397 A1 Dec. 31, 2009

(30) Foreign Application Priority Data

Jun. 30, 2008 (JP) ..... 2008-171508

(51) Int. Cl.
*H01R 12/24* (2006.01)

(52) U.S. Cl. ..... 439/493

(58) Field of Classification Search ..... 439/76.1, 439/77, 493, 497

See application file for complete search history.

(56) References Cited

U.S. PATENT DOCUMENTS

| | | | | | |
|---|---|---|---|---|---|
| 4,023,879 | A | * | 5/1977 | Braund et al. | 439/76.1 |
| 4,445,742 | A | * | 5/1984 | Fullam | 439/597 |
| 4,448,474 | A | * | 5/1984 | Melnychenko | 439/472 |
| 4,639,054 | A | * | 1/1987 | Kersbergen | 439/59 |
| 4,871,319 | A | * | 10/1989 | Babow | 439/77 |
| 4,993,968 | A | * | 2/1991 | Guletsky et al. | 439/492 |
| 5,364,292 | A | * | 11/1994 | Bethurum | 439/607.02 |
| 5,679,008 | A | * | 10/1997 | Takahashi et al. | 439/76.1 |
| 5,683,261 | A | * | 11/1997 | Ahles et al. | 439/189 |
| 5,873,743 | A | * | 2/1999 | Tkazyik et al. | 439/76.1 |
| 5,934,942 | A | * | 8/1999 | Patel et al. | 439/607.5 |
| 5,957,727 | A | * | 9/1999 | Page, Jr. | 439/607.58 |
| 6,083,047 | A | * | 7/2000 | Paagman | 439/607.07 |
| 6,371,805 | B1 | * | 4/2002 | Wang et al. | 439/581 |
| 6,380,485 | B1 | * | 4/2002 | Beaman et al. | 174/88 R |
| 6,386,919 | B2 | * | 5/2002 | Medina et al. | 439/607.46 |
| 6,582,252 | B1 | * | 6/2003 | Lin | 439/607.46 |
| 6,739,904 | B2 | * | 5/2004 | Wu | 439/497 |
| 6,976,869 | B1 | * | 12/2005 | Wu | 439/499 |
| 7,147,512 | B2 | * | 12/2006 | Wu | 439/607.05 |
| 7,179,117 | B2 | * | 2/2007 | Wu | 439/460 |
| 7,297,028 | B2 | * | 11/2007 | Daikuhara et al. | 439/607.46 |
| 7,510,425 | B2 | * | 3/2009 | Kuo et al. | 439/493 |
| 7,845,983 | B2 | * | 12/2010 | Kawada et al. | 439/607.46 |
| 2009/0301761 | A1 | * | 12/2009 | Wu | 174/250 |

FOREIGN PATENT DOCUMENTS

| | | | |
|---|---|---|---|
| JP | 2004-22413 | A | 1/2004 |
| JP | 2005-190691 | A | 7/2005 |
| TW | 231126 | * | 9/1994 |

* cited by examiner

*Primary Examiner* — Neil Abrams
(74) *Attorney, Agent, or Firm* — Ipusa, PLLC

(57) ABSTRACT

A cable connector includes a contact assembly including an electrically insulating block body and multiple signal contacts incorporated therein; an intermediary interconnection board having multiple contact connection pads, multiple groups of wire connection pads, and multiple interconnects on its surface, the interconnects connecting the contact connection pads to the corresponding wire connection pads, the contact connection pads being electrically connected to the corresponding signal contacts of the contact assembly; and a cable having multiple wires electrically connected to the corresponding wire connection pads. Adjacent groups of the wire connection pads are offset in a direction in which the interconnects extend in a manner to reduce crosstalk.

7 Claims, 13 Drawing Sheets

CABLE CONNECTOR INCLUDING INTERMEDIARY INTERCONNECTION BOARD

BACKGROUND OF THE INVENTION

1. Field of the Invention

The present invention relates generally to cable connectors, and more particularly to a cable connector for differential transmission (differential transmission cable connector).

2. Description of the Related Art

Data transmission systems include a normal transmission system and a differential transmission system. The normal transmission system employs an electric wire for each data item. The differential transmission system, using a pair of electric wires for each data item, simultaneously transmits a "+" signal to be transmitted and a "−" signal equal in magnitude and opposite in direction to the "+" signal. The differential transmission system, which has the advantage of being less susceptible to noise compared with the normal transmission system, is widely used in fields where signals are transmitted at high speed.

FIG. 1 is a schematic diagram illustrating a conventional differential transmission cable connector 1. FIG. 2 is a cross-sectional view of the differential transmission cable connector 1. FIG. 3 is an exploded view of an intermediary part of the differential transmission cable connector 1 illustrated in FIG. 2. In FIG. 1 through FIG. 3, X1-X2, Y1-Y2, and Z1-Z2 indicate the directions of width, length, and height, respectively, of the differential transmission cable connector 1.

As illustrated in FIG. 1 and FIG. 2, the differential transmission cable connector 1 includes a contact assembly 10, two intermediary interconnection boards (paddle cards) 20, and a differential transmission cable 60.

The intermediary interconnection boards 20 are attached to the back side (cable side) of the contact assembly 10. The differential transmission cable 60 has its end connected to the corresponding end of each of the intermediary interconnection boards 20. A shield housing 80 covers the contact assembly 10, the intermediary interconnection boards 20, and the end portion of the cable 60.

Referring to FIG. 3, first, second, and third contact connection pads 32, 34, and 36; first, second, and third wire connection pads 42, 44, and 46; and first, second, and third interconnects (interconnection lines) 52, 54, and 56 that connect the first, second, and third contact connection pads 32, 34, and 36 to the corresponding first, second, and third wire connection pads 42, 44, and 46 are formed on an upper surface 24 of each intermediary interconnection board 20.

The contact assembly 10 includes first signal contacts 12, second signal contacts 14, and ground contacts 16 soldered to the first, second, and third contact connection pads 32, 34, and 36, respectively. Further, first signal wires 72, second signal wires 74, and drain wires 76 at the end of the differential transmission cable 60 are soldered to the first, second, and third wire connection pads 42, 44, and 46, respectively.

Referring back to FIG. 1, each intermediary interconnection board 20 has a substantially rectangular shape. On the upper surface 24 of each intermediary interconnection board 20, the interconnects 52, 54, and 56 are formed with the same length, and the wire connection pads 42, 44, and 46 are aligned in a single row in the X1-X2 directions.

For related art, reference may be made to Japanese Laid-Open Patent Applications No. 2005-190691 and No. 2004-22413.

SUMMARY OF THE INVENTION

According to one aspect of the present invention, a cable connector includes a contact assembly including an electrically insulating block body and a plurality of signal contacts incorporated therein; an intermediary interconnection board having a plurality of contact connection pads, a plurality of groups of wire connection pads, and a plurality of interconnects on a surface thereof, the interconnects connecting the contact connection pads to the corresponding wire connection pads, the contact connection pads being electrically connected to the corresponding signal contacts of the contact assembly; and a cable having a plurality of wires electrically connected to the corresponding wire connection pads, wherein adjacent ones of the groups of the wire connection pads are offset in a direction in which the interconnects extend.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 3:
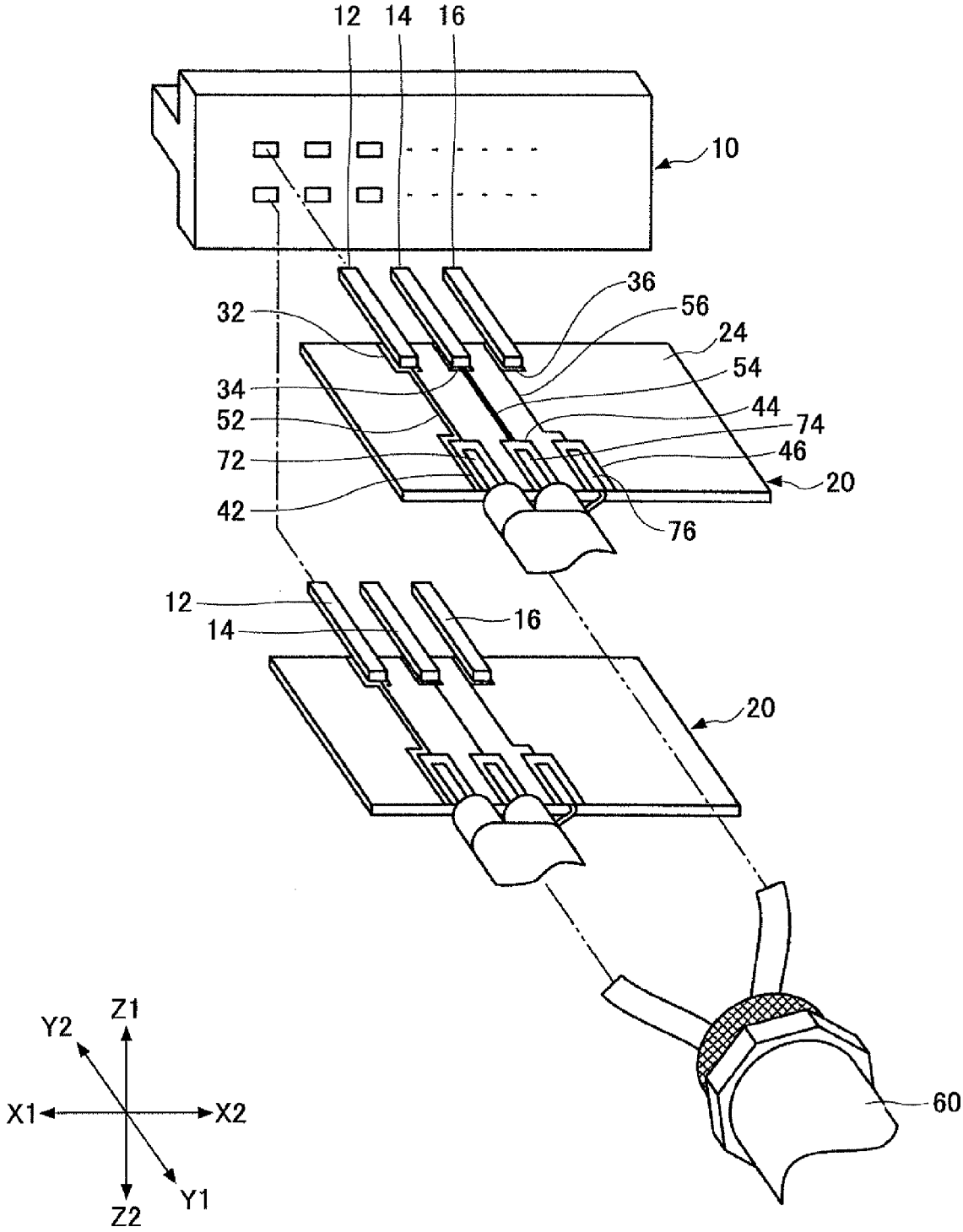
FIG.3 RELATED ART
FIG. 3 is an exploded view of an intermediary part of the differential transmission cable connector of FIG. 2.

As described above, in the conventional differential transmission cable connector 1, the wire connection pads 42, 44, and 46 are provided on each intermediary interconnection board 20 as illustrated in FIG. 3.

Compared with the interconnects 52, 54, and 56, however, the wire connection pads 42, 44, and 46 are wide (in the X1-X2 directions) for the purpose of connecting the signal wires 72 and 74 and the drain wire 76. As a result, the gap (interval) between adjacent wire connection pads 42, 44, and 46 is narrower than the gap (interval) between adjacent interconnects 52, 54, and 56. This causes the problem of high crosstalk at a portion of the intermediary interconnection board 20 where the wires 72, 74, and 76 are soldered.

According to an embodiment of the present invention, there is provided a cable connector with reduced crosstalk at a portion of an intermediary interconnection board where cable wires are soldered.

A description is given below, with reference to the accompanying drawings, of embodiments of the present invention.

First Embodiment

Figure 1:
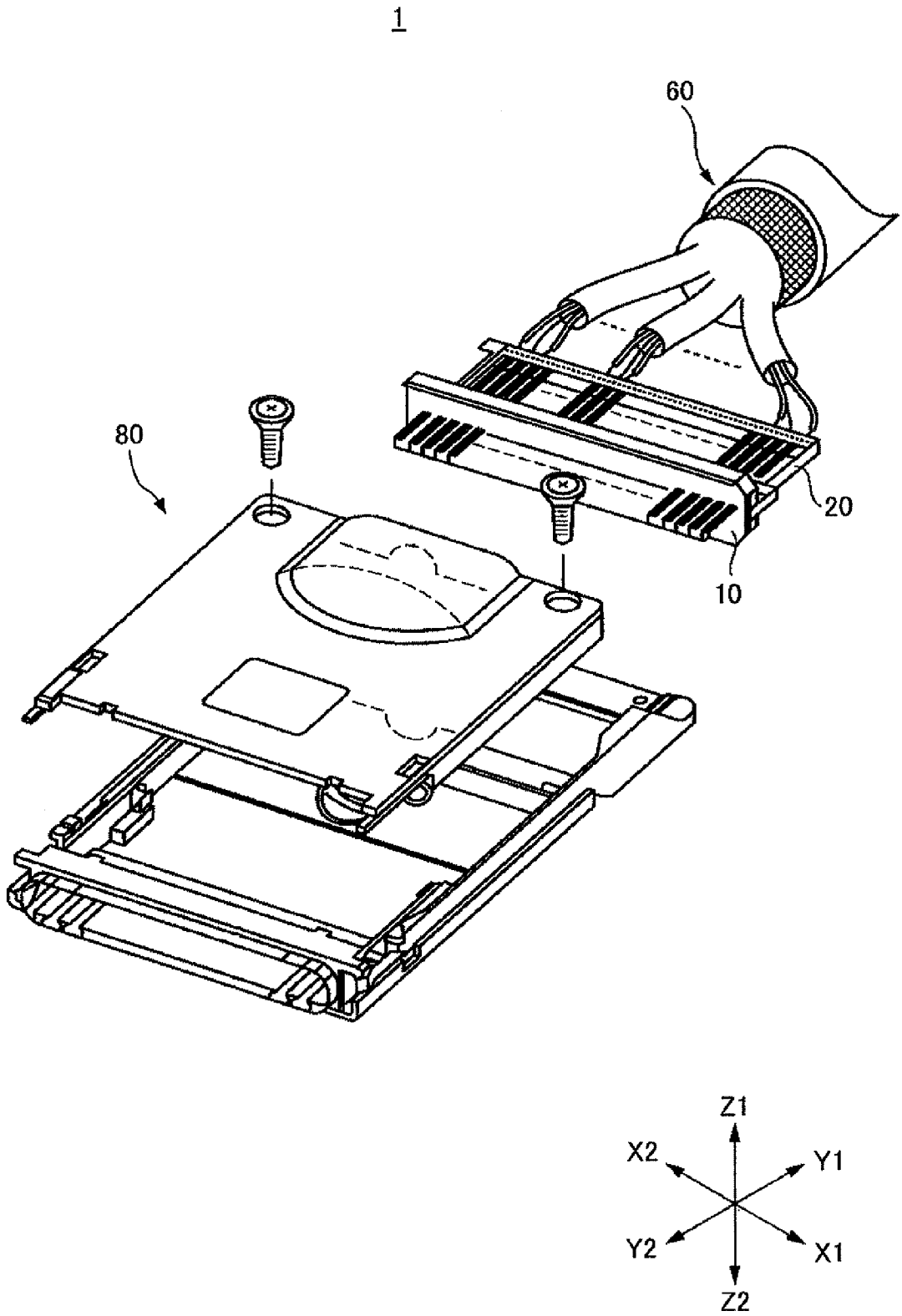
FIG.1 RELATED ART
FIG. 1 is a schematic diagram illustrating a conventional differential transmission cable connector.
Figure 2:
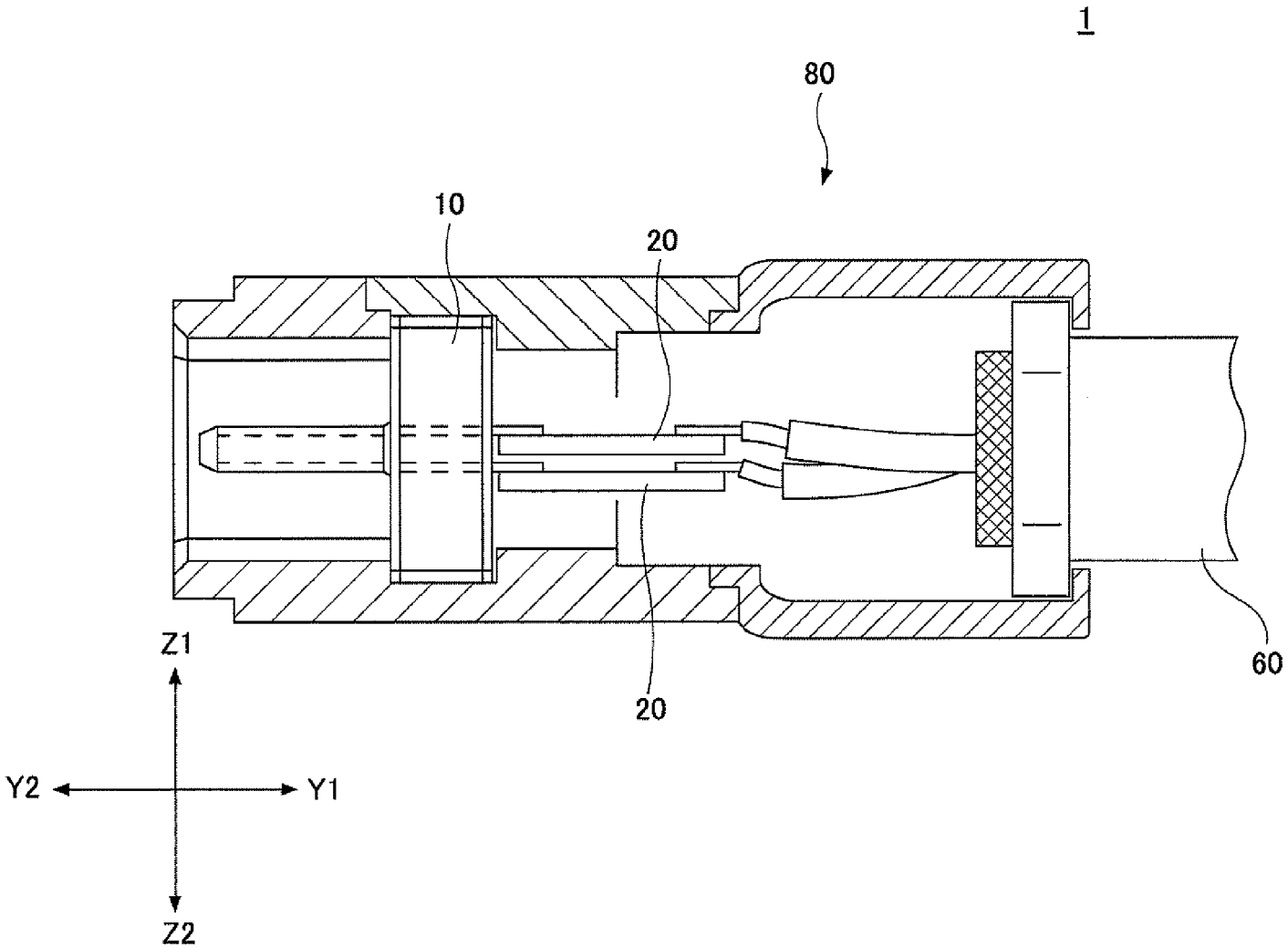
FIG.2 RELATED ART
FIG. 2 is a cross-sectional view of the differential transmission cable connector of FIG. 1.
Figure 4:
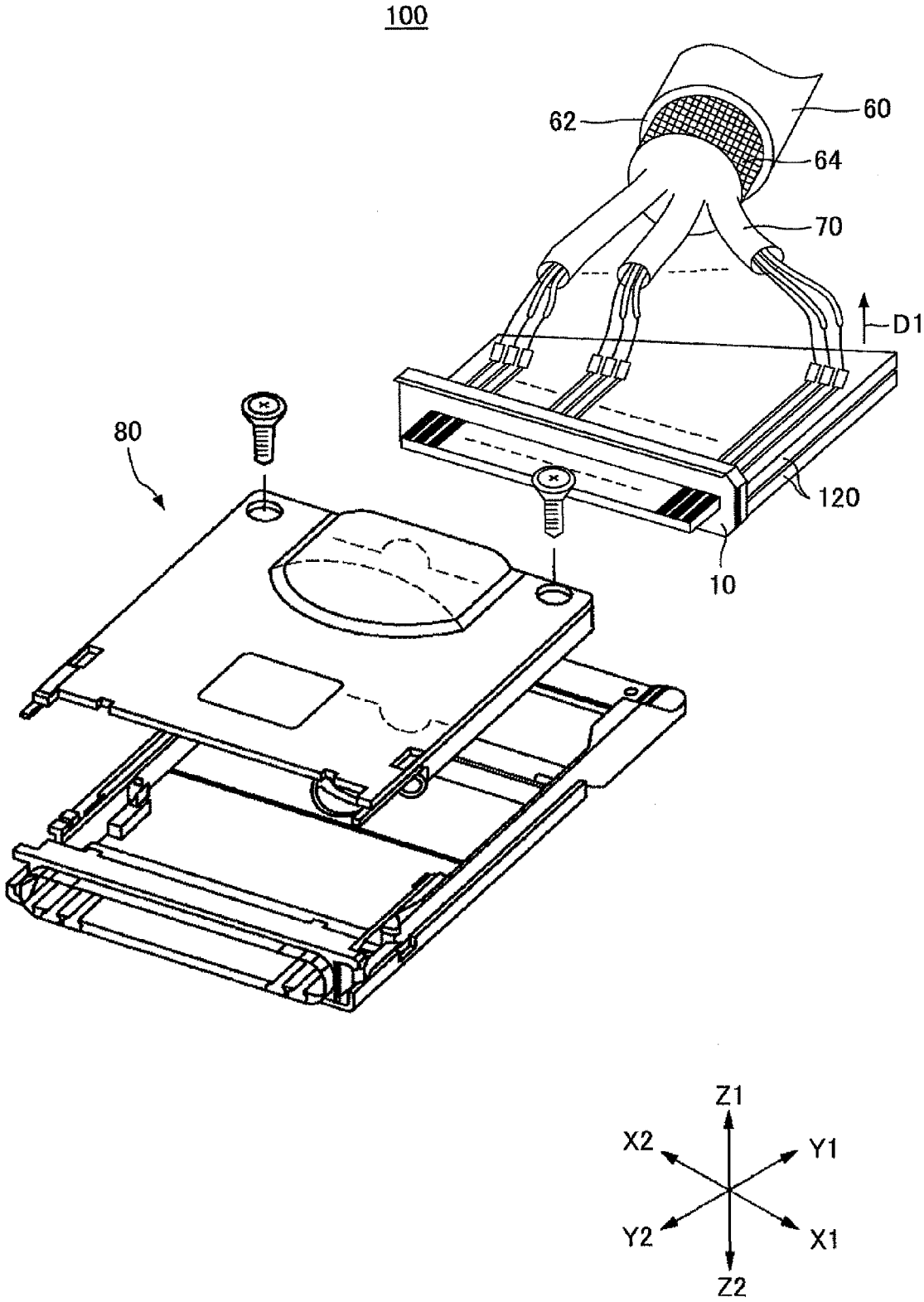
FIG. 4 is a schematic diagram illustrating a differential transmission cable connector according to a first embodiment of the present invention.
Figure 5:
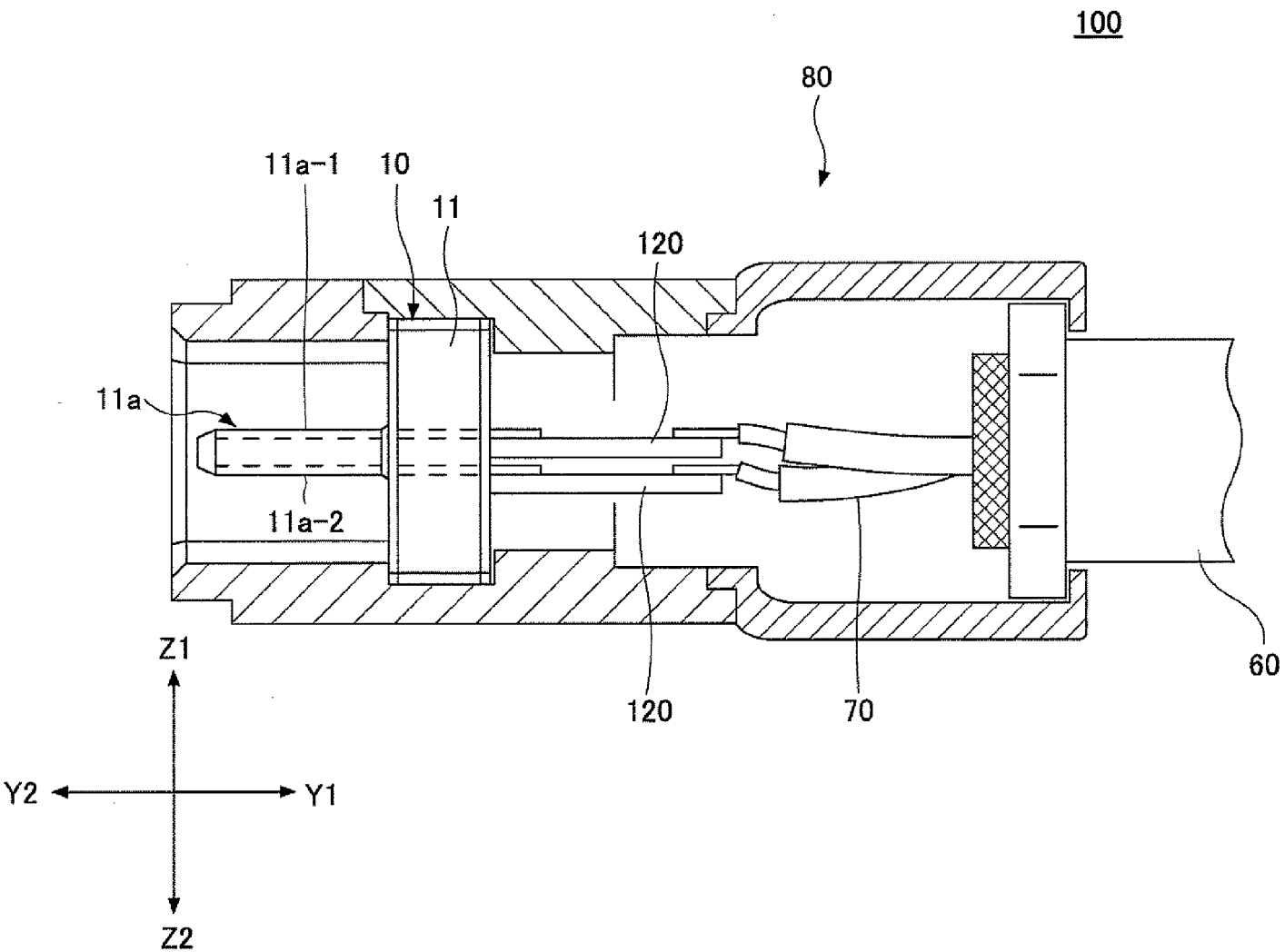
FIG. 5 is a cross-sectional view of the differential transmission cable connector according to the first embodiment of the present invention.
Figure 6:
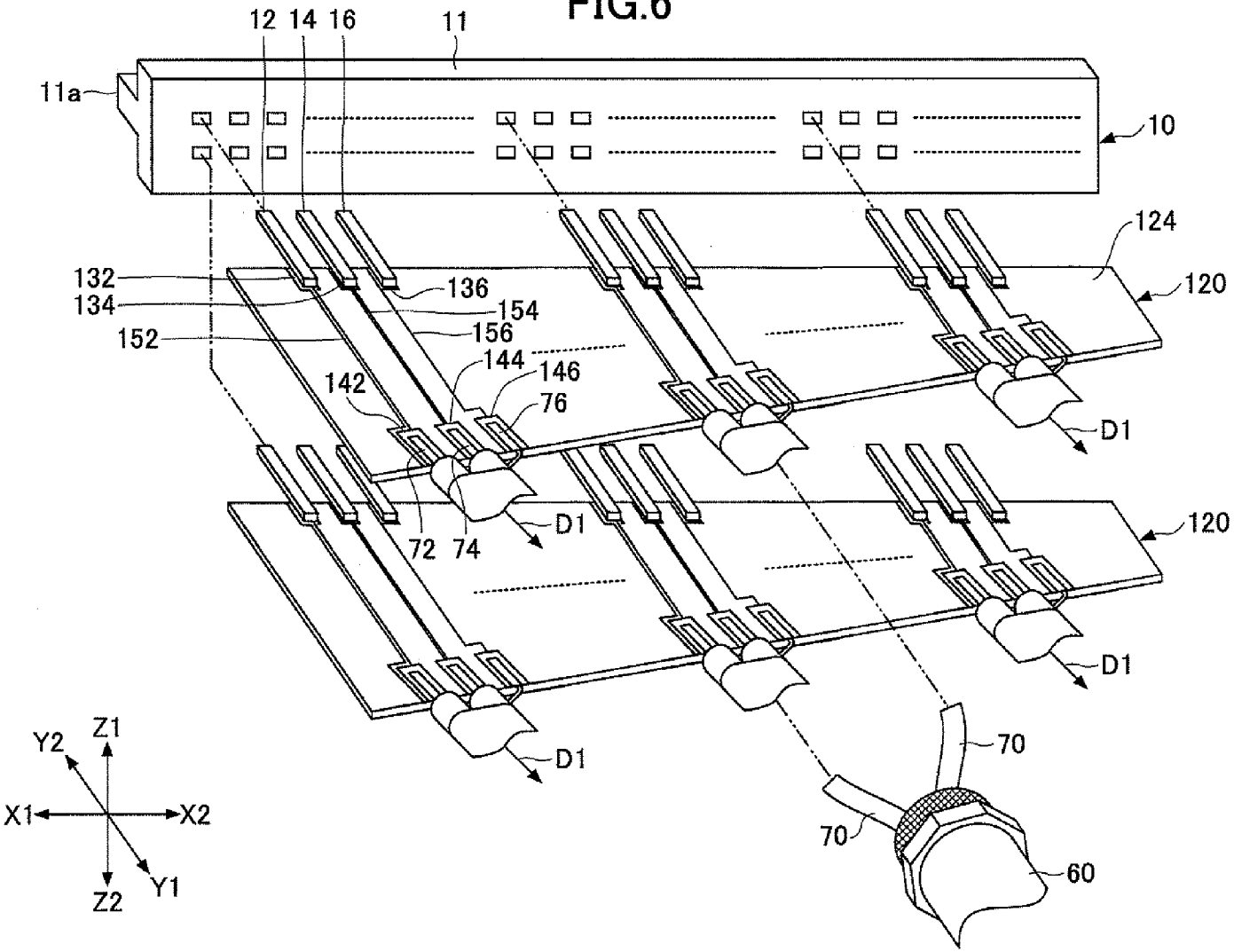
FIG. 6 is a schematic exploded view of an intermediary portion of the differential transmission cable connector illustrated in FIG. 5 according to the first embodiment of the present invention.
Figure 7:
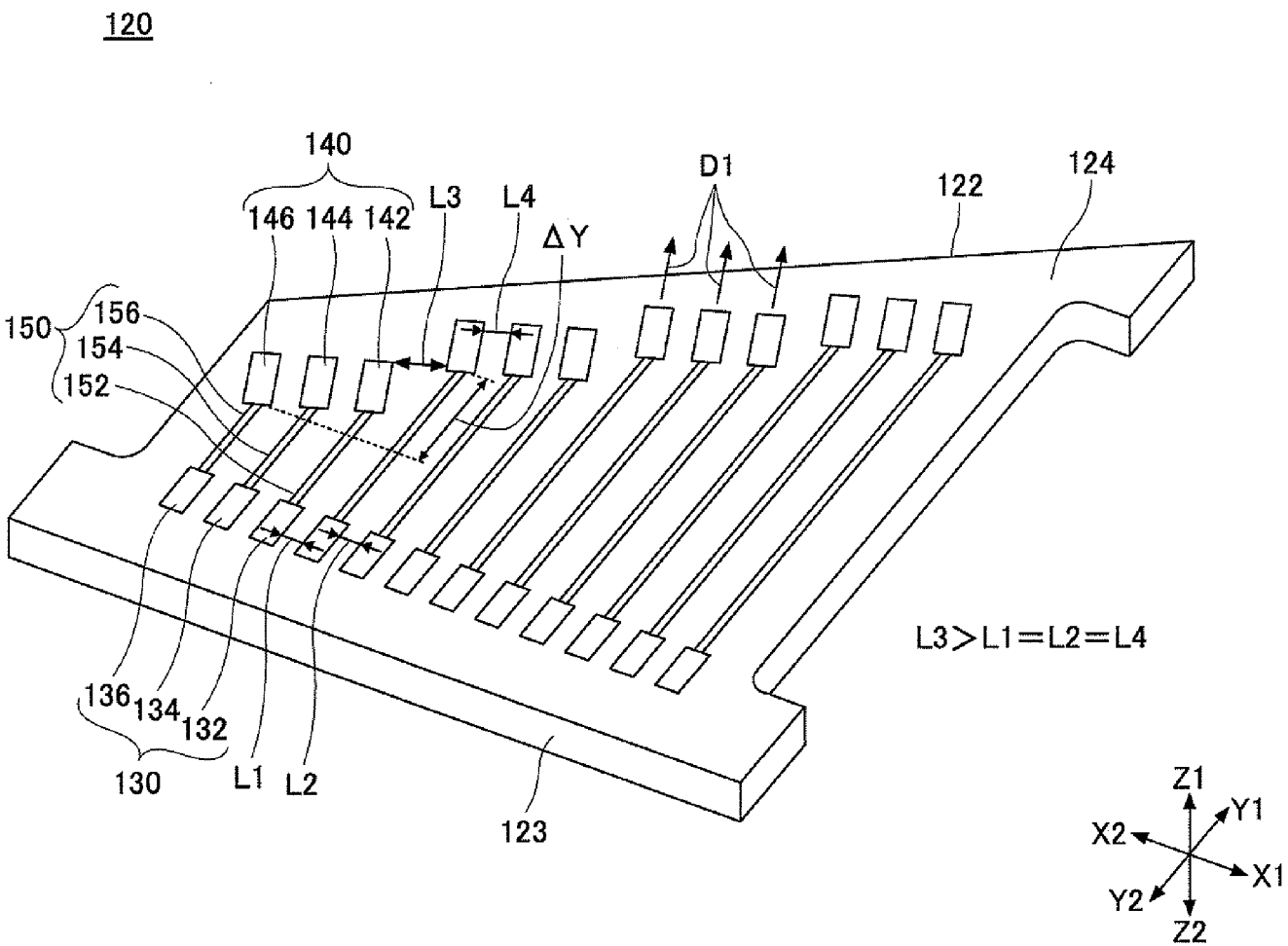
FIG. 7 is a schematic diagram illustrating an interconnection board according to the first embodiment of the present invention.
Figure 8A:
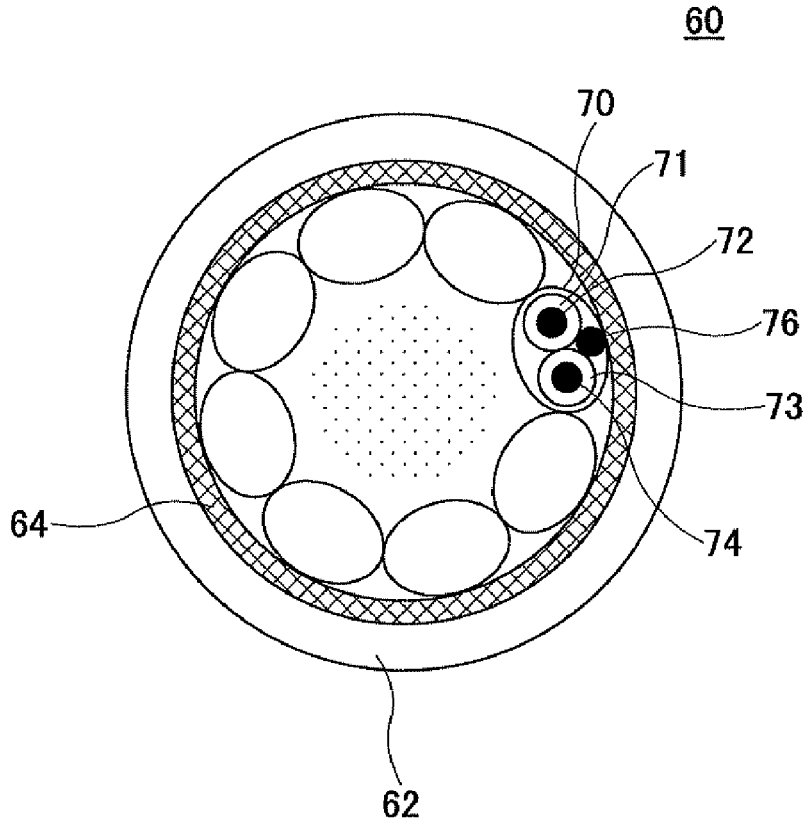
FIGS. 8A and 8B are diagrams illustrating a differential transmission cable according to the first embodiment of the present invention.
Figure 8B:
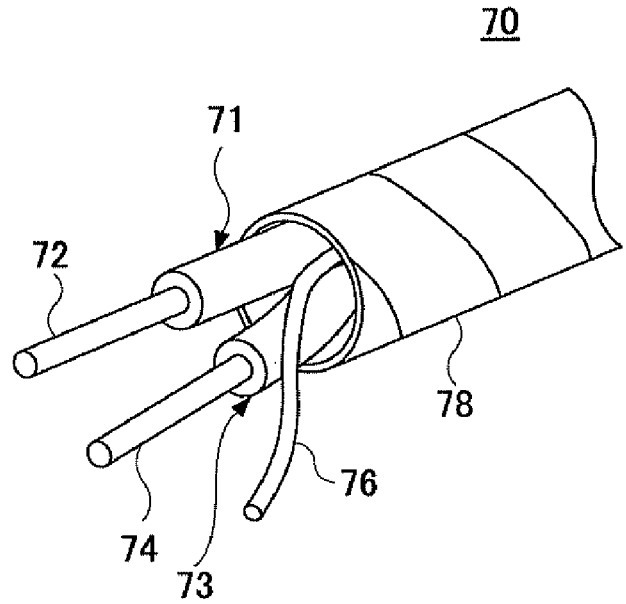

FIG. 4 is a schematic diagram illustrating a differential transmission cable connector 100 according to a first embodiment of the present invention. FIG. 5 is a cross-sectional view of the differential transmission cable connector 100. FIG. 6 is a schematic exploded view of an intermediary portion of the differential transmission cable connector 100 illustrated in FIG. 5. FIG. 7 is a schematic diagram illustrating an intermediary interconnection board 120. FIGS. 8A and 8B are diagrams illustrating a differential transmission cable 60. In FIG. 4 through FIG. 8B, X1-X2, Y1-Y2, and Z1-Z2 indicate the directions of width, length, and height, respectively, of the differential transmission cable connector 100. In FIG. 4 through FIG. 8B, the same elements as those of FIG. 1 through FIG. 3 are referred to by the same reference numerals.

Referring to FIG. 4, the differential transmission cable connector 100 includes a contact assembly 10, the intermediary interconnection boards 120, and the differential transmission cable 60.

As illustrated in FIG. 4 and FIG. 5, the differential transmission cable connector 100 is a plug type connector, and the plug-type contact assembly 10 is incorporated in a shield housing 80.

Referring to FIG. 6 as well as FIG. 4, the contact assembly 10 includes an electrically insulating block body 11, first signal contacts 12, second signal contacts 14, and ground contacts 16. The first signal contacts 12, the second signal contacts 14, and the ground contacts 16 are incorporated in the electrically insulating block body 11 and arranged in horizontal rows (in the X1-X2 directions) and vertical columns (in the Z1-Z2 directions) in a matrix manner. That is, the contacts 12, 14, and 16 are arranged vertically in respective columns, and the columns of the contacts 12, the columns of the contacts 14, and the columns of the contacts 16 alternate with one another in this order in the X2 direction, so that multiple sets of contacts 12, 14, and 16 are arranged in the X2 direction in each row. Each pair of first and second signal contacts 12 and 14 forms a contact pair for transmitting positive and negative signals having complementary waveforms in axial symmetry.

Referring to FIG. 5 and FIG. 6, the block body 11 includes a projecting plug body part 11*a* on its Y2 side. Multiple grooves (not graphically illustrated) are formed at predetermined intervals along the X1-X2 directions on an upper surface 11*a*-1 and a lower surface 11*a*-2 of the plug body part 11*a*.

The first and second signal contacts 12 and 14 and the ground contacts 16 are incorporated in the block body 11 in such a manner as to penetrate the block body 11 in the Y2 direction from the Y1 side. The contacts 12, 14, and 16 have their respective Y2-side end portions fit into the corresponding grooves of the plug body part 11*a* and exposed on the upper and lower surfaces 11*a*-1 and 11*a*-2 of the plug body part 11*a*. On the other hand, the contacts 12, 14, and 16 have their respective Y1-side end portions projecting in the Y1 direction from the block body 11.

As illustrated in FIG. 5 and FIG. 6, the intermediary interconnection boards 120 are arranged in two tiers at a predetermined interval in the Z1-Z2 directions.

Referring to FIG. 7 as well as FIG. 6, each intermediary interconnection board 120 has a substantially quadrangular shape with a Y1-side edge 122, connected to the end of the cable 60, being inclined at an angle to a Y2-side edge 123 so that the distance between the Y1-side edge 122 and the Y2-side edge 123 increases in the X1 direction. Therefore, the intermediary interconnection boards 120 each have a longer Y1-side edge (Y1-side edge 122) to be connected to a cable (the cable 60) than the conventional rectangular intermediary interconnection boards 20 illustrated in FIG. 1 through FIG. 3.

Further, first, second, and third contact connection pads 132, 134, and 136; first, second, and third wire connection pads 142, 144, and 146; and first, second, and third interconnects (interconnection lines) 152, 154, and 156 that connect the first, second, and third contact connection pads 132, 134, and 136 to the corresponding first, second, and third wire connection pads 142, 144, and 146 are formed on an upper (Z1-side) surface 124 of each intermediary interconnection board 20.

The first, second, and third interconnects 152, 154, and 156, which are elongated in the Y1-Y2 directions to be shaped like strips, are arranged side by side in the X1-X2 directions, so that multiple interconnect groups 150, each formed of one first interconnect 152, one second interconnect 154, and one third interconnect 156, are arranged side by side in the X1-X2 directions.

The first, second, and third contact connection pads 132, 134, and 136 are connected to the Y2-side ends of the first, second, and third interconnects 152, 154, and 156, respectively. The first, second, and third wire connection pads 142, 144, and 146 are connected to the Y1-side ends of the first, second, and third interconnects 152, 154, and 156, respectively.

The first, second, and third contact connection pads 132, 134, and 136, which have a rectangular shape elongated in the directions in which the first, second, and third interconnects 152, 154, and 156 extend (Y1-Y2 directions), are arranged side by side in the X1-X2 directions, so that multiple contact connection pad groups 130, each formed of one first contact connection pad 132, one second contact connection pad 134, and one third contact connection pad 136, are arranged side by side in the X1-X2 directions. The distance (interval) L1 between adjacent contact connection pad groups 130 is equal to the distance (interval) L2 between adjacent contact connection pads 132, 134, and 136 in each contact connection pad group 130.

On the other hand, the first, second, and third wire connection pads 142, 144, and 146, which have a rectangular shape elongated obliquely (at an angle) (in the direction indicated by arrows D1 in FIG. 7) with respect to the directions in which the first, second, and third interconnects 152, 154, and 156 extend (Y1-Y2 directions), are arranged side by side along the Y1-side edge 122 of each intermediary interconnection board 120, so that multiple wire connection pad groups 140, each formed of one first wire connection pad 142, one second wire connection pad 144, and one third wire connection pad 146, are arranged side by side along the Y1-side edge 122.

Adjacent wire connection pad groups 140 are arranged with an offset ΔY (FIG. 7) in the directions in which the first, second, and third interconnects 152, 154, and 156 extend (Y1-Y2 directions). That is, the interconnect groups 150 are different in interconnect length. For example, as illustrated in FIG. 6 and FIG. 7, the interconnect groups 150 increase in interconnect length in the X1 direction. That is, the interconnects 152, 154, and 156 progressively increase in length in the X1 direction. Thus, the adjacent interconnects 152, 154, and 156 are offset in the Y1-Y2 directions as illustrated in FIG. 7.

As a result, the distance (interval) L3 between the adjacent wire connection pad groups 140 is greater than the distance L1 between the corresponding adjacent contact connection pad groups 130. The distance (interval) L3 between the adjacent wire connection pad groups 140 is greater than the distance (interval) L4 between the adjacent wire connection pads 142, 144, and 146 in each wire connection pad group 140. The distance L4 is equal to the distance L2.

The crosstalk at a portion of each intermediary interconnection board 120 where the wires 72 and 74 are soldered is determined by the distance L3 between the adjacent wire connection pad groups 140. The distance L3 is greater than the distance L1 between the adjacent contact connection pad groups 130, so that the crosstalk is reduced compared with the conventional intermediary interconnection boards 20 illustrated in FIG. 1 through FIG. 3.

Referring to FIG. 8A, the differential transmission cable 60 has multiple, for example, eight electric wire assemblies 70 contained inside a tube having a double cover structure formed of an outer jacket 62 and a shielding mesh wire 64.

Referring to FIG. 8B, each electric wire assembly 70 has signal electric wires 71 and 73 with insulating coating and a drain wire 76 bound and shielded with a spirally wound metal tape 78. The signal electric wires 71 and 73 form a pair for differential signal transmission. The signal electric wires 71 and 73 and the drain wire 76 extend outward from the end of each electric wire assembly 70. The ends of the signal electric wires 71 and 73 are processed so as to expose a first signal wire 72 and a second signal wire 74, respectively.

Referring back to FIG. 4 through FIG. 6, the differential transmission cable connector 100 has the two intermediary interconnection boards 120 connected to the back side (Y1 or cable side) of the contact assembly 10. The differential transmission cable 60 has its end connected to the ends of the intermediary interconnection boards 120. The shield housing 80 covers the contact assembly 10, the intermediary interconnection boards 120, and the end portion of the cable 60.

The Y2-side edges 123 of the intermediary interconnection boards 120 are fit and fixed to the back side (Y1 side) of the contact assembly 10 with the first contact connection pads 132 being soldered to the Y1-side ends of the corresponding first signal contacts 12, the second contact connection pads 134 being soldered to the Y1-side ends of the corresponding second signal contacts 14, and the third contact connection pads 136 being soldered to the Y1-side ends of the corresponding ground contacts 16.

The differential transmission cable 60 has the first and second signal wires 72 and 74 and the drain wire 76 at the end of each electric wire assembly 70 soldered to the first, second, and third wire connection pads 142, 144, and 146, respectively, of the corresponding wire connection pad group 140 (FIG. 7). The differential transmission cable 60 is connected to the Y1-side edges 122 of the intermediary interconnection boards 120 to extend along the direction in which the first, second, and third wire connection pads 142, 144, and 146 extend (the direction indicated by arrows D1 in FIG. 6 and FIG. 7).

As described above, according to the differential transmission cable connector 100, the adjacent wire connection pad groups 140 are arranged with the offset ΔY in the directions in which the first, second, and third interconnects 152, 154, and 156 extend (Y1-Y2 directions). Accordingly, the distance L3 between the adjacent wire connection pad groups 140 is greater in the differential transmission cable connector 100 than in the conventional differential transmission cable connector 1 illustrated in FIG. 1 through FIG. 3. Accordingly, compared with the conventional configuration, the crosstalk is reduced at portions of the intermediary interconnection boards 120 where the wires 72 and 74 are soldered.

Further, according to the differential transmission cable connector 100, the wire connection pads 142, 144, and 146 extend obliquely (at an angle) (in the direction indicated by arrows D1) with respect to the directions in which the first, second, and third interconnects 152, 154, and 156 extend (Y1-Y2 directions). This allows the differential transmission cable 60 to extend from the differential transmission cable connector 100 in the direction indicated by arrows D1 without being forced to bend. This prevents an excessive stress from being applied to the differential transmission cable 60, and also obviates the need for space for bending the differential transmission cable 60.

Second Embodiment

Figure 9:
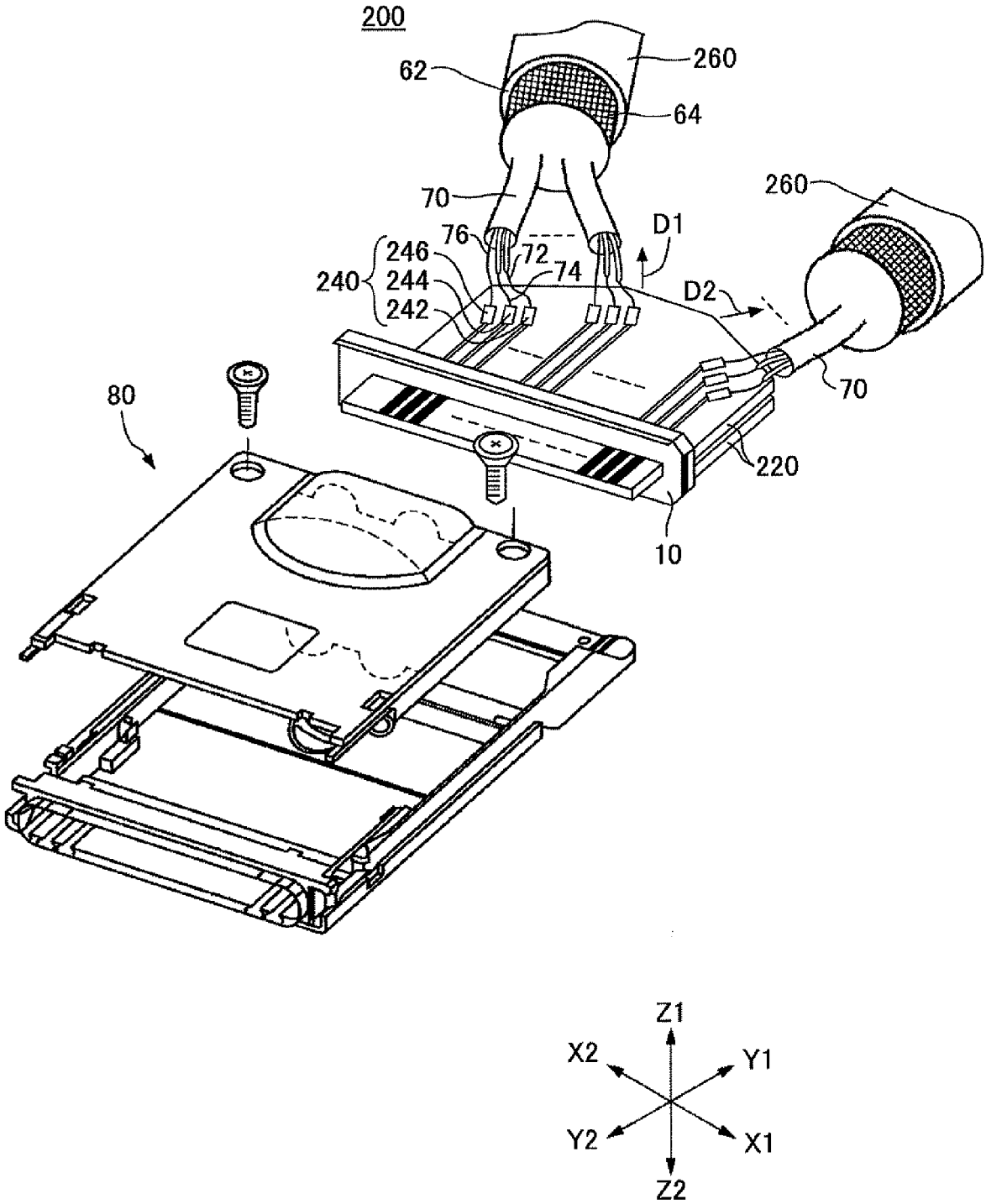
FIG. 9 is a schematic diagram illustrating a differential transmission cable connector according to a second embodiment of the present invention.
Figure 10:
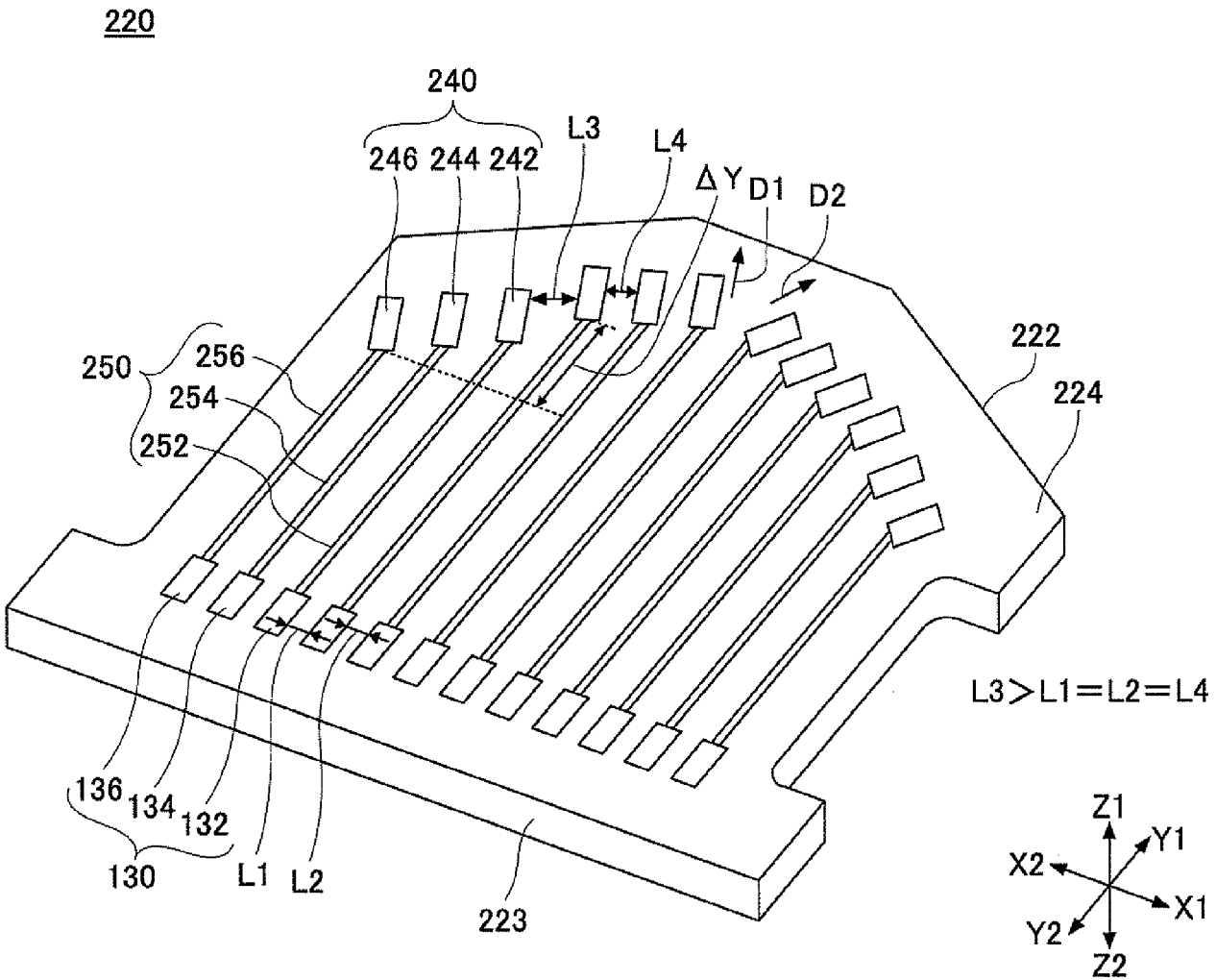
FIG. 10 is a schematic diagram illustrating an intermediary interconnection board according to the second embodiment of the present invention.

FIG. 9 is a schematic diagram illustrating a differential transmission cable connector 200 according to a second embodiment of the present invention. FIG. 10 is a schematic diagram illustrating an intermediary interconnection board 220. In FIG. 9 and FIG. 10, X1-X2, Y1-Y2, and Z1-Z2 indicate the directions of width, length, and height, respectively, of the differential transmission cable connector 200.

Referring to FIG. 9, the differential transmission cable connector 200 includes the contact assembly 10, the intermediary interconnection boards 220, and differential transmission cables 260. In the following description, the same elements as those of the differential transmission cable connector 100 described with reference to FIG. 4 through FIG. 8B are referred to by the same reference numerals, and a description thereof is omitted.

As illustrated in FIG. 9, the differential transmission cable connector 200 is a plug type connector, and the plug-type contact assembly 10 is incorporated in the shield housing 80.

Like the intermediary interconnection boards 120 of the first embodiment, the intermediary interconnection boards 220 are arranged in two tiers at a predetermined interval in the Z1-Z2 directions. Referring to FIG. 10, unlike the intermediary interconnection boards 120, each intermediary interconnection board 220 has a substantially hexagonal shape with a Y1-side edge 222, connected to the ends of the cables 260, being angularly bent to bulge in a direction (Y1 direction) perpendicular to a Y2-side edge 223 (X1-X2 directions). The intermediary interconnection boards 220 each have a longer Y1-side edge (Y1-side edge 222) to be connected to cables (cables 260) than the conventional rectangular intermediary interconnection boards 20 illustrated in FIG. 1 through FIG. 3. The intermediary interconnection boards 220 may also have other polygonal shapes such as a pentagonal shape.

Further, the first, second, and third contact connection pads 132, 134, and 136; first, second, and third wire connection pads 242, 244, and 246; and first, second, and third interconnects (interconnection lines) 252, 254, and 256 that connect the first, second, and third contact connection pads 132, 134, and 136 to the corresponding first, second, and third wire connection pads 242, 244, and 246 are formed on an upper (Z1-side) surface 224 of each intermediary interconnection board 220.

The first, second, and third interconnects 252, 254, and 256, which are elongated in the Y1-Y2 directions to be shaped like strips, are arranged side by side in the X1-X2 directions, so that multiple interconnect groups 250, each formed of one first interconnect 252, one second interconnect 254, and one third interconnect 256, are arranged side by side in the X1-X2 directions.

The first, second, and third contact connection pads 132, 134, and 136 are connected to the Y2-side ends of the first, second, and third interconnects 252, 254, and 256, respectively. The first, second, and third wire connection pads 242, 244, and 246 are connected to the Y1-side ends of the first, second, and third interconnects 252, 254, and 256, respectively.

The first, second, and third wire connection pads 242, 244, and 246, which have a rectangular shape elongated obliquely (at an angle) (in the direction indicated by arrows D1 or arrows D2 in FIG. 10) with respect to the directions in which the first, second, and third interconnects 252, 254, and 256 extend (Y1-Y2 directions), are arranged side by side along the Y1-side edge 222 of each intermediary interconnection board 220, so that multiple wire connection pad groups 240, each formed of one first wire connection pad 242, one second wire connection pad 244, and one third wire connection pad 246, are arranged side by side along the Y1-side edge 222.

Adjacent wire connection pad groups 240 extending in the same direction (indicated by arrows D1 or D2) are arranged with an offset ΔY (FIG. 10) in the directions in which the first, second, and third interconnects 252, 254, and 256 extend (Y1-Y2 directions). That is, the interconnect groups 250 corresponding to the wire connection pad groups 240 extending in the same direction are different in interconnect length. For example, as illustrated in FIG. 9 and FIG. 10, the interconnect groups 250 decrease in Y1-Y2 directions interconnect length from the center toward the X1 side and the X2 side in the X1-X2 directions. That is, the interconnects 252, 254, and 256 decrease in length respectively from the center toward the X1 side and the X2 side in the X1-X2 directions. That is, adjacent interconnects 252, 254, and 256 corresponding to the wire connection pad groups 240 extending in the same direction are offset in the Y1-Y2 directions as illustrated in FIG. 10. Thus, the interconnect groups 250 are arranged in a shape projecting in a direction (Y1 direction) perpendicular to the X1-X2 directions.

As a result, the distance (interval) L3 between the adjacent wire connection pad groups 240 extending in the same direction is greater than the distance L1 between the corresponding adjacent contact connection pad groups 130. The distance (interval) L3 between the adjacent wire connection pad groups 240 is greater than the distance (interval) L4 between adjacent wire connection pads 242, 244, and 246 in each wire connection pad group 240. The distance L4 is equal to the distance L2.

The crosstalk at a portion of each intermediary interconnection board 220 where the wires 72 and 74 (FIG. 9) are soldered is determined by the distance L3 between the adjacent wire connection pad groups 240. The distance L3 is greater than the distance L1 between adjacent contact connection pad groups 130, so that the crosstalk is reduced compared with the conventional intermediary interconnection boards 20 illustrated in FIG. 1 through FIG. 3.

Referring to FIG. 9, the differential transmission cables 260 each have multiple, for example, four electric wire assemblies 70 contained inside a tube having a double cover structure formed of the outer jacket 62 and the shielding mesh wire 64. (See also FIGS. 8A and 8B.) In FIG. 9, some of the electric wire assemblies 70 are not shown for convenience of graphical illustration.

Referring to FIG. 9, the differential transmission cable connector 200 has the two intermediary interconnection boards 220 connected to the back side (Y1 or cable side) of the contact assembly 10. The two differential transmission cables 260 have their respective ends connected to the ends of the intermediary interconnection boards 220. The shield housing 80 covers the contact assembly 10, the intermediary interconnection boards 220, and the end portions of the cables 260.

The differential transmission cables 260 have the first and second signal wires 72 and 74 and the drain wire 76 at the end of each electric wire assembly 70 soldered to the first, second, and third wire connection pads 242, 244, and 246, respectively, of the corresponding wire connection pad group 240 (FIG. 9 and FIG. 10). The differential transmission cables 260 are connected to the Y1-side edge 222 of the intermediary interconnection boards 220 to extend along the direction in which the first, second, and third wire connection pads 242, 244, and 246 extend (the direction indicated by arrows D1 or D2 in FIG. 9 and FIG. 10).

As described above, according to the differential transmission cable connector 200, adjacent wire connection pad groups 240 extending in the same direction are arranged with the offset ΔY in the directions in which the first, second, and third interconnects 252, 254, and 256 extend (Y1-Y2 directions). Accordingly, the distance L3 between the adjacent wire connection pad groups 240 is greater in the differential transmission cable connector 200 than in the conventional differential transmission cable connector 1 illustrated in FIG. 1 through FIG. 3. Accordingly, compared with the conventional configuration, the crosstalk is reduced at portions of the intermediary interconnection boards 220 where the signal wires 72 and 74 are soldered.

Further, according to the differential transmission cable connector 200, the wire connection pads 242, 244, and 246 extend obliquely in two directions (in the direction indicated by arrows D1 and the direction indicated by arrows D2) with respect to the directions in which the first, second, and third interconnects 252, 254, and 256 extend (Y1-Y2 directions). This allows the differential transmission cables 260 to extend from the differential transmission cable connector 200 in the two directions (indicated by arrows D1 and arrows D2) without being forced to bend. This prevents an excessive stress from being applied to the differential transmission cables 260, and also eliminates the need for space for bending the differential transmission cables 260.

Third Embodiment

Figure 11:
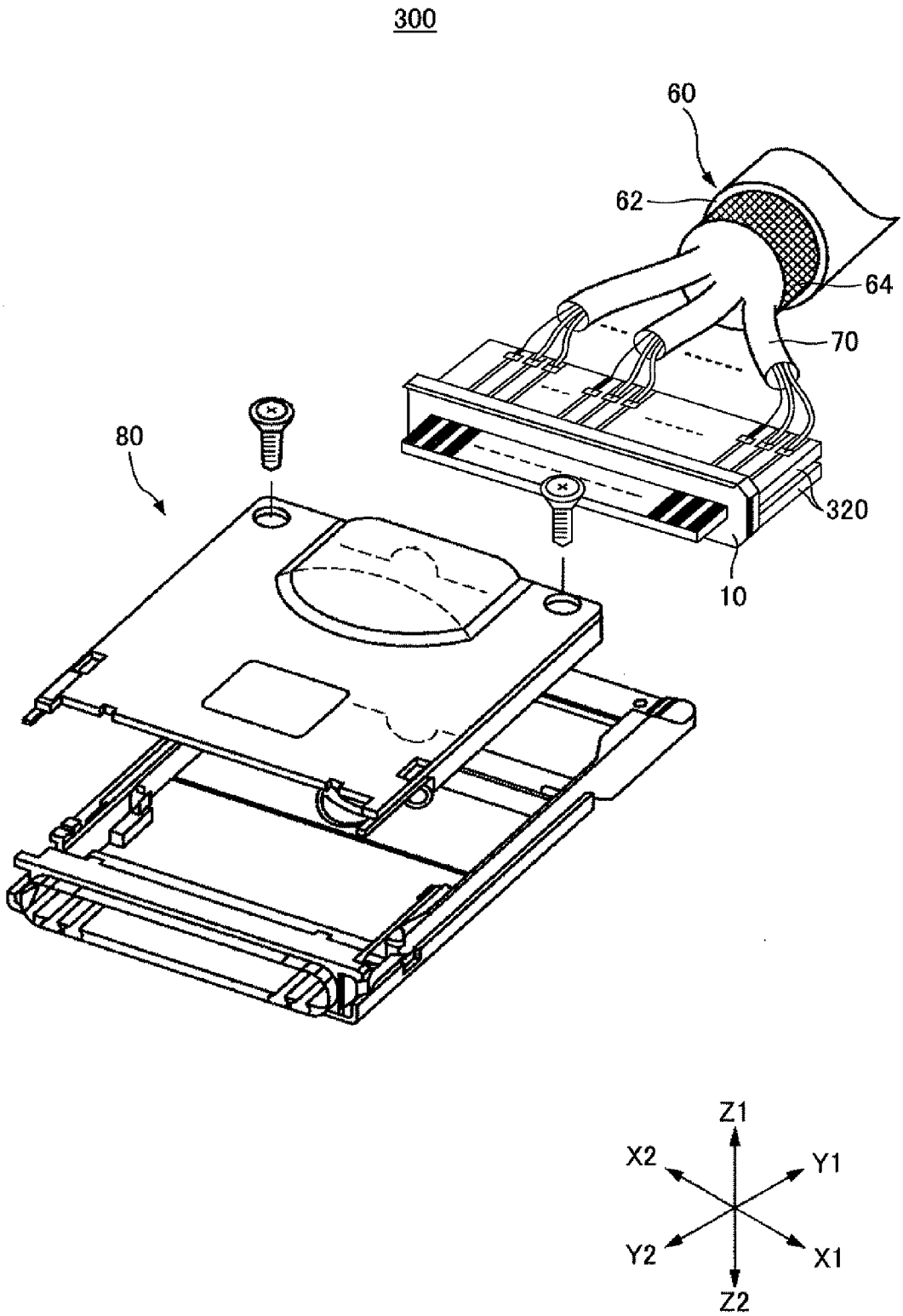
FIG. 11 is a schematic diagram illustrating a differential transmission cable connector according to a third embodiment of the present invention.
Figure 12:
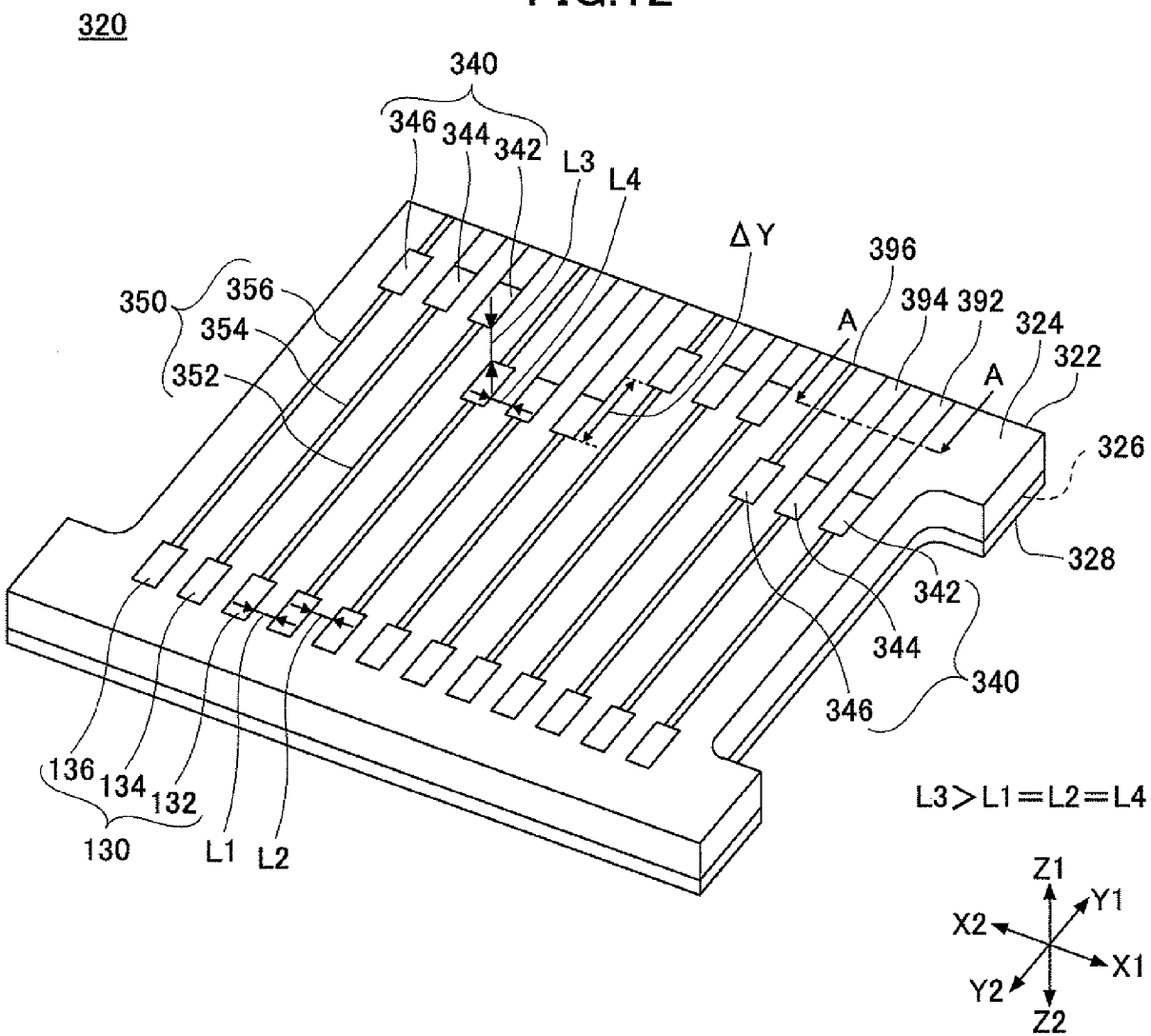
FIG. 12 is a schematic diagram illustrating an intermediary interconnection board according to the third embodiment of the present invention.
Figure 13:
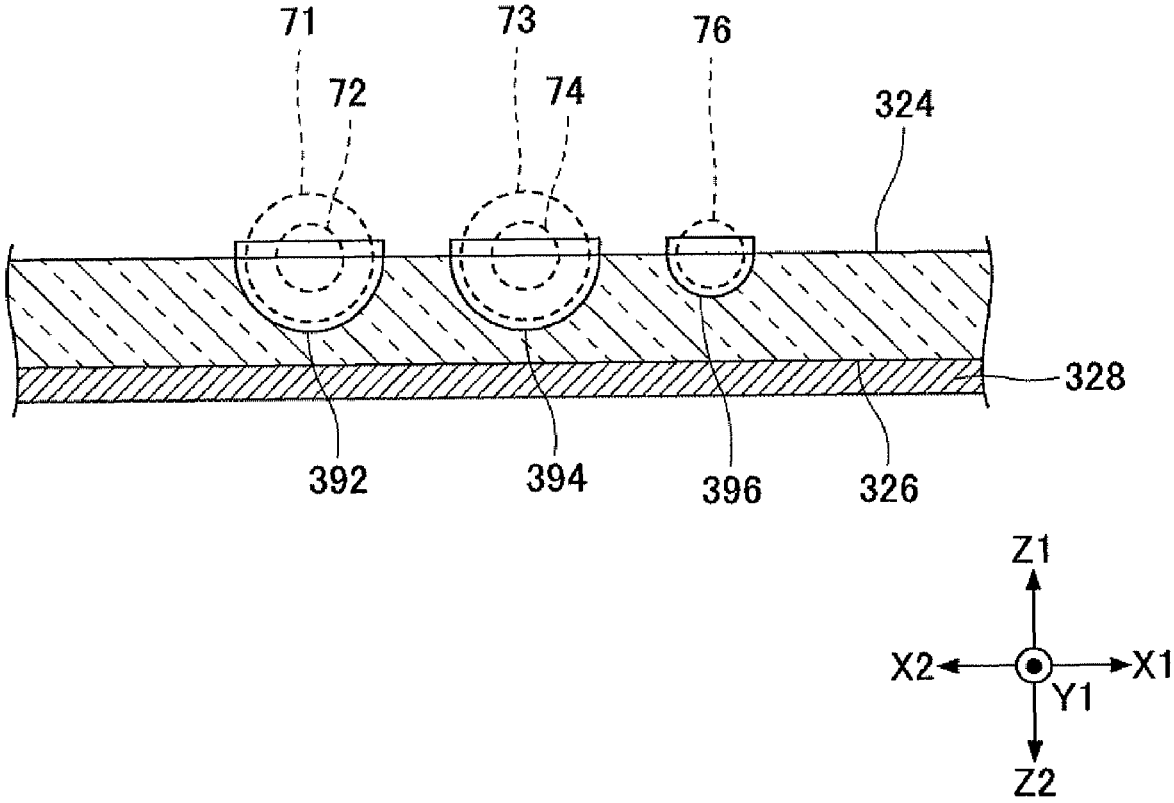
FIG. 13 illustrates a cross section of part of the intermediary interconnection board taken along the one-dot chain line whose ends are marked by arrows A in FIG. 12, where the cross section is viewed in the direction indicated by arrows A, according to the third embodiment of the present invention.

FIG. 11 is a schematic diagram illustrating a differential transmission cable connector 300 according to a third embodiment of the present invention. FIG. 12 is a schematic diagram illustrating an intermediary interconnection board 320. FIG. 13 illustrates a cross section of part of the intermediary interconnection board 320 taken along the one-dot chain line whose ends are marked by arrows A in FIG. 12, where the cross section is viewed in the direction indicated by arrows A. In FIG. 11 through FIG. 13, X1-X2, Y1-Y2, and Z1-Z2 indicate the directions of width, length, and height, respectively, of the differential transmission cable connector 300.

Referring to FIG. 11, the differential transmission cable connector 300 includes the contact assembly 10, the intermediary interconnection boards 320, and the differential transmission cable 60. In the following description, the same elements as those of the differential transmission cable connector 100 described with reference to FIG. 4 through FIG. 8B are referred to by the same reference numerals, and a description thereof is omitted.

As illustrated in FIG. 11, the differential transmission cable connector 300 is a plug type connector, and the plug-type contact assembly 10 is incorporated in the shield housing 80.

Like the intermediary interconnection boards 120 of the first embodiment, the intermediary interconnection boards 320 are arranged in two tiers at a predetermined interval in the Z1-Z2 directions. Referring to FIG. 12, unlike the intermediary interconnection boards 120, each intermediary interconnection board 220 has a substantially rectangular shape. The first, second, and third contact connection pads 132, 134, and 136; first, second, and third wire connection pads 342, 344, and 346; and first, second, and third interconnects (interconnection lines) 352, 354, and 356 that connect the first, second, and third contact connection pads 132, 134, and 136 to the corresponding first, second, and third wire connection pads 342, 344, and 346 are formed on an upper (Z1-side) surface 324 of each intermediary interconnection board 320.

The first, second, and third interconnects 352, 354, and 356, which are elongated in the Y1-Y2 directions to be shaped like strips, are arranged side by side in the X1-X2 directions, so that multiple interconnect groups 350, each formed of one first interconnect 352, one second interconnect 354, and one third interconnect 356, are arranged side by side in the X1-X2 directions.

The first, second, and third contact connection pads 132, 134, and 136 are connected to the Y2-side ends of the first, second, and third interconnects 352, 354, and 356, respectively. The first, second, and third wire connection pads 342, 344, and 346 are connected to the Y1-side ends of the first, second, and third interconnects 352, 354, and 356, respectively.

The first, second, and third wire connection pads 342, 344, and 346, which have a rectangular shape elongated in the directions in which the first, second, and third interconnects 352, 354, and 356 extend (Y1-Y2 directions), are arranged side by side in the X1-X2 directions, so that multiple wire connection pad groups 340, each formed of one first wire connection pad 342, one second wire connection pad 344, and one third wire connection pad 346, are arranged side by side in the X1-X2 directions.

Adjacent wire connection pad groups 340 are arranged with an offset ΔY (FIG. 12) in the directions in which the first, second, and third interconnects 352, 354, and 356 extend (Y1-Y2 directions). That is, the interconnect groups 350 are different in interconnect length. For example, as illustrated in FIG. 12, the interconnect groups 350 alternate in Y1-Y2 directions interconnect length between a first length and a second length smaller than the first length along the X1-X2 directions. That is, the interconnects 352, 354, and 356 alternate in length respectively between the first length and the second length along the X1-X2 directions, so that the wire connection pad groups 340 are positioned in a zigzag manner along the X1-X2 directions.

As a result, the distance (interval) L3 between the adjacent wire connection pad groups 340 is greater than the distance L1 between the corresponding adjacent contact connection pad groups 130. The distance (interval) L3 between the adjacent wire connection pad groups 340 is greater than the distance (interval) L4 between adjacent wire connection pads 342, 344, and 346 in each wire connection pad group 340. The distance L4 is equal to the distance L2. The distance L3 may be a distance between the closest pad corners of the adjacent wire connection pad groups 340 as illustrated in FIG. 12.

The crosstalk at a portion of each intermediary interconnection board 320 where the wires 72 and 74 (FIG. 11) are soldered is determined by the distance L3 between the adjacent wire connection pad groups 340. The distance L3 is greater than the distance L1 between the adjacent contact connection pad groups 130, so that the crosstalk is reduced compared with the conventional intermediary interconnection boards 20 illustrated in FIG. 1 through FIG. 3.

Further, a ground layer 328 is provided at a position corresponding to the wire connection pads 342, 344, and 346 between the intermediary interconnection boards 320. For example, as illustrated in FIG. 12 and FIG. 13, the ground layer 328 may be formed on an entire lower surface (Z2-side surface) 326 of at least an upper one of the intermediary interconnection boards 320. As a result, compared with the conventional configuration, the crosstalk is reduced between a portion of the upper intermediary interconnection board 320 where the wires 72 and 74 are soldered and a portion of the lower intermediary interconnection board 320 where the wires 72 and 74 are soldered.

Further, referring to FIG. 12 and FIG. 13 as well as FIG. 8B, guide grooves 392, 394, and 396 that guide the signal electric wire 71 having the first signal wire 72 covered therein, the signal electric wire 73 having the second signal wire 74 covered therein, and the drain wire 76, respectively, in the directions in which the wire connection pads 342, 344, and 346 extend (Y1-Y2 directions) are formed on the upper surface 324 of each intermediary interconnection board 320. Since the signal electric wires 71 and 73 and the drain wire 76 are positioned by the guide grooves 392, 394, and 396, respectively, it is easier to solder the wires 72, 74, and 76 than conventionally.

Further, referring to FIG. 11, the differential transmission cable connector 300 has the two intermediary interconnection boards 320 connected to the back side (Y1 or cable side) of the contact assembly 10. The differential transmission cable 60 has its end connected to the ends of the intermediary interconnection boards 320. The shield housing 80 covers the contact assembly 10, the intermediary interconnection boards 320, and the end portion of the cable 60.

The differential transmission cable 60 has the first and second signal wires 72 and 74 and the drain wire 76 at the end of each electric wire assembly 70 soldered to the first, second, and third wire connection pads 342, 344, and 346, respectively, of the corresponding wire connection pad group 340 (FIG. 11 and FIG. 12). The differential transmission cable 60 is connected to a Y1-side edge 322 (FIG. 12) of each intermediary interconnection board 320 to extend along the direction in which the first, second, and third wire connection pads 342, 344, and 346 extend (Y1-Y2 directions).

As described above, according to the differential transmission cable connector 300, the adjacent wire connection pad groups 340 are arranged with the offset ΔY in the directions in which the first, second, and third interconnects 352, 354, and 356 extend (Y1-Y2 directions). Accordingly, the distance L3 between the adjacent wire connection pad groups 340 is greater in the differential transmission cable connector 300 than in the conventional differential transmission cable connector 1 illustrated in FIG. 1 through FIG. 3. Accordingly, compared with the conventional configuration, the crosstalk is reduced at portions of the intermediary interconnection boards 320 where the wires 72 and 74 are soldered.

The present invention is not limited to the specifically disclosed embodiments, and variations and modifications may be made without departing from the scope of the present invention.

For example, the differential transmission cable connectors 100, 200, and 300 of the first through third embodiments, which are described above as plug-type cable connectors, may be of a jack type as long as they include an intermediary interconnection board.

Further, the differential transmission cable connectors 100, 200, and 300 of the first through third embodiments are described above as having two intermediary interconnection boards (120, 220, and 320) connected to a single contact assembly (10). However, the number of intermediary interconnection boards to be connected to the contact assembly is not limited. For example, four intermediary interconnection boards may be connected to a single contact assembly.

Further, the ground layer 328 provided on the lower surface 326 of at least an upper one of the intermediary interconnection boards 320 of the third embodiment may also be provided on the lower surface of at least an upper one of the intermediary interconnection boards 120 of the first embodiment and/or on the lower surface of at least an upper one of the intermediary interconnection boards 220 of the second embodiment.

Further, guide grooves such as the guide grooves 392, 394, and 396 of the third embodiment may also be formed on the upper surfaces 124 of the intermediary interconnection boards 120 of the first embodiment and/or the upper surfaces 224 of the intermediary interconnection boards 220 of the second embodiment.

The present application is based on Japanese Priority Patent Application No. 2008-171508, filed on Jun. 30, 2008, the entire contents of which are incorporated herein by reference.

What is claimed is:

1. A cable connector, comprising:

a contact assembly including an electrically insulating block body and a plurality of signal contacts incorporated therein;

an intermediary interconnection board having a plurality of contact connection pads, a plurality of groups of adjacent wire connection pads, and a plurality of interconnects on a surface thereof, interconnects connecting the contact connection pads to the corresponding wire connection pads, the contact connection pads being electrically connected to the corresponding signal contacts of the contact assembly; and a cable having a plurality of wires electrically connected to the corresponding wire connection pads, wherein adjacent ones of the groups of the adjacent wire connection pads in a direction along a first edge of the intermediary interconnection board opposed to a second edge thereof along which the contact connection pads are arranged are offset in a direction in which the interconnects extend, so that the groups of the adjacent wire connection pads are arranged at a first interval greater than a second interval at which the adjacent wire connection pads are arranged in each of the groups thereof.

2. The cable connector as claimed in claim 1, wherein the adjacent wire connection pads in each of the groups thereof are offset in the direction in which the interconnects extend.

3. The cable connector as claimed in claim 1, wherein the wire connection pads extend obliquely with respect to the direction in which the interconnects extend.

4. The cable connector as claimed in claim 3, wherein the wire connection pads extend in a plurality of directions.

5. The cable connector as claimed in claim 1, wherein a ground layer is provided at a position corresponding to the wire connection pads on a surface of the intermediary interconnection board facing away from the surface thereof on which the wire connection pads are provided.

6. The cable connector as claimed in claim 1, wherein the intermediary interconnection board includes a plurality of guide grooves on the surface thereof, the guide grooves guiding the wires of the cable.

7. The cable connector as claimed in claim 6, wherein at least one of the wires has insulating coating.

* * * * *